United States Patent [19]

Williams

[11] Patent Number: 4,581,771

[45] Date of Patent: Apr. 15, 1986

[54] DEVICE FOR PREVENTING RIDING IN WOMEN'S PANTS

[76] Inventor: Catherine V. Williams, 7709 San Felipe, #203, Houston, Tex. 77063

[21] Appl. No.: 587,075

[22] Filed: Mar. 7, 1984

[51] Int. Cl.[4] ..... A41D 13/00; A41D 9/04

[52] U.S. Cl. ..... 2/2; 2/408

[58] Field of Search ..... 2/406, 2, 1, 67, 408, 2/234

[56] References Cited

U.S. PATENT DOCUMENTS 3,339,208 9/1967 Marbach ..... 2/67

3,909,847 10/1975 Holt et al. ..... 2/2

*Primary Examiner*—Doris L. Troutman

*Attorney, Agent, or Firm*—Arnold, White & Durkee

[57] ABSTRACT

A curved insert is disclosed that can be worn between a woman's pants and underpants preventing the pants from riding up between the labia at the entrance to the vagina.

1 Claim, 4 Drawing Figures

Fig. 1
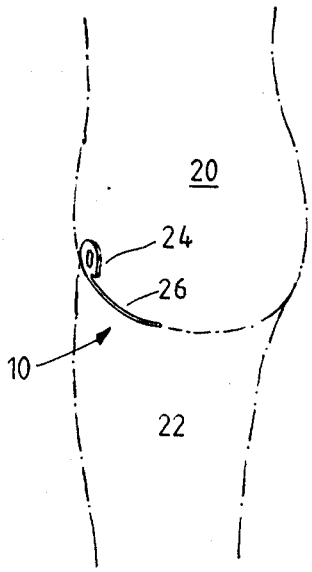
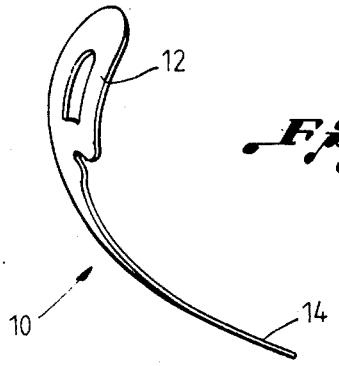
Fig. 2
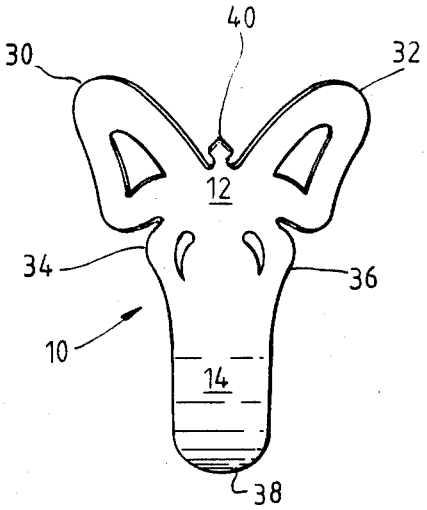
Fig. 3
Fig. 4
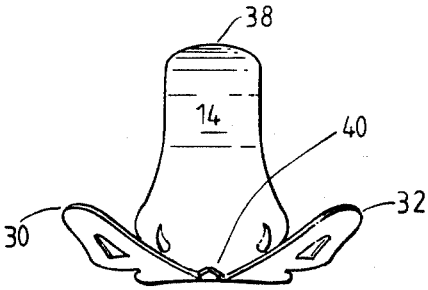

DEVICE FOR PREVENTING RIDING IN WOMEN'S PANTS

BACKGROUND OF THE INVENTION

The present invention concerns a problem with women's clothing. More particularly, it concerns a device for preventing women's pants from riding up between the labia at the entrance to the vagina.

"Pants" is used in this specification and the following claims to refer to jeans and slacks as opposed to underpants. Problems with underwear creeping or riding up in the buttocks have been recognized in the past. U.S. Pat. Nos. 2,166,012 to LaMaida, U.S. Pat. No. Re. 21,624 to Dann, U.S. Pat. No. 2,450,168 to Schwartz, and U.S. Pat. No. 4,355,425 to Jones are examples that recognize that problem. All of those of patents appear to attempt to solve the buttocks riding problem with various arrangements of elastic and straps in and on underpants.

Several of those patents refer to riding or bunching in the "crotch" area. When these patents are examined in detail, it becomes apparent that they refer to riding of underpants over or between the buttocks. Thus, although they focus on a nearby portion of the anatomy, they do not disclose the problems of women's pants riding up between the labia at the entrance to the vagina, or suggest any solution to it.

There is a long-standing need for a practical, comfortable solution to this problem.

SUMMARY OF THE INVENTION

A device for unobtrusively preventing women's pants from riding up between the labia at the entrance to the vagina in accordance with the present invention includes an insert adapted for wearing inside the user's pants and outside her underpants, which covers the labia, extends upward in front to approximately the area of the pubic bone, and is contoured to fit the user's body.

Such a device can take various changes, but it will preferably be thin enough so its presence will not be noticeable outside the pants for aesthetic reasons. In other words, it should be thin enough to produce no readily visible outward bulge or indentation in the pants. Relative thinness will also usually improve the comfortability of the device.

It is unnecessary for the device to extend substantially further backward than the vagina area, and likewise unnecessary for it to extend further upward in front than approximately the area of the pubic bone.

A device in accordance with the present invention will prevent the discomfort of pants riding up between the labia, and will also be an aesthetic improvement by preventing this problem.

BRIEF DESCRIPTION OF THE DRAWINGS

FIG. 1 is a side view of a female body wearing an insert in accordance with the present invention, with the near leg not shown.

FIG. 2 is a side view of the insert.

FIG. 3 is a front view.

FIG. 4 is a top view.

DETAILED DESCRIPTION OF A SPECIFIC EMBODIMENT

The insert 10 shown in FIGS. 1–4, and most specifically in FIGS. 2 and 3, has an upper member 12 and a lower member 14. The upper member 12 in this case has a butterfly-like shape. However, the upper member 12 is not limited to any particular shape. For example, the gaps in the upper member 12 which create the butterfly appearance could be filled in, thus making it generally triangular. Decoratively shaped upper members are preferred.

As can best be seen in FIG. 2, the upper member 12 and lower member 14 are joined to form one smoothly continuous insert 10. The insert 10 is curved in a way designed to fit the contours of the user's body. The lower member 14 extends between the user's legs, so its length will usually be greater than its width.

Since people come in different shapes and sizes, the dimensions and curvature of the inserts will need to be varied to accommodate those differences. This might be done by having large, medium, and small sizes, or by some other gradation.

FIG. 1 shows the insert 10 as it would be worn by a female user. This figure shows only the user's pelvic region 20, the far leg 22, and the insert 10.

The insert 10 extends upward to approximately the area of the pubic bone 24. It needs to extend back between the legs only far enough to cover the vagina area 26.

As mentioned above, the dimensions of the insert will vary, but a typical thickness is approximately 1/16 inch. Referring to FIG. 3, a typical distance between points 30 and 32 might be 3 to 3½ inches, and between points 34 and 36, 1½ and 2½ inches. A line drawn along the surface of the insert 10 from point 30 to the bottom tip 38 of lower member 14 would be about 5 to 6 inches, while a line between points 38 and 40 (the center of upper member 12 in the butterfly embodiment) would be approximately 4 to 5 inches.

A wide variety of materials could be used to construct such an insert. Acrylic resins and polyethylene are two possibilities. Suitable materials need not be absolutely rigid, but instead can have various degrees of flexibility. The crucial flexibility requirement is that the insert be firm enough so that it will not itself ride up between the labia.

The preceeding description is intended to illustrate one embodiment, not to list all possible embodiments. Those skilled in the art will appreciate than many modifications could be made that would fall within the scope and spirit of the claims that follow.

I claim:

1. A device for unobstrusively preventing women's pants from riding up between the labia at the entrance to the vagina, comprising an insert adapted for wearing inside the user's pants and outside her underpants, the insert having a concave curvature so as to conform to the contours of the user's body in the vaginal area, being sufficiently rigid so it will not itself ride up between the labia, and including:

a lower member whose length only covers at least part of the labia at the entrance to the vagina, whose width is small enough to allow it to fit between the user's legs, and which terminates in a curved end; and an upper member which is connected to the lower member to form a smoothly continuous insert, and which has a width greater than that of the lower member.

* * * * *